US009498958B2

(12) United States Patent
Shindo

(10) Patent No.: US 9,498,958 B2
(45) Date of Patent: Nov. 22, 2016

(54) LIQUID JETTING APPARATUS

(71) Applicant: Brother Kogyo Kabushiki Kaisha, Nagoya-shi, Aichi-ken (JP)

(72) Inventor: Tatsuya Shindo, Nagoya (JP)

(73) Assignee: BROTHER KOGYO KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 14/868,564

(22) Filed: Sep. 29, 2015

(65) Prior Publication Data

US 2016/0089887 A1 Mar. 31, 2016

(30) Foreign Application Priority Data

Sep. 30, 2014 (JP) ..... 2014-202353

(51) Int. Cl.
*B41J 2/17* (2006.01)
*B41J 2/165* (2006.01)

(52) U.S. Cl.
CPC ..... *B41J 2/16526* (2013.01); *B41J 2/16508* (2013.01); *B41J 2/1714* (2013.01); *B41J 2002/1657* (2013.01)

(58) Field of Classification Search
CPC .... B41J 2/1714; B41J 2/1721; B41J 2/1728; B41J 2/1735; B41J 2/1742; B41J 2/185; B41J 2/165; B41J 2/16505; B41J 2/16517; B41J 2/1652; B41J 29/17; B41J 2/16523; B41J 2/16532; B41J 2002/1856
USPC ..... 347/9, 29, 30, 31, 32, 33, 34, 36
See application file for complete search history.

(56) References Cited

U.S. PATENT DOCUMENTS

| | | | | |
|---|---|---|---|---|
| 6,617,983 | B1 * | 9/2003 | Platz | H01H 13/702 200/512 |
| 7,044,579 | B2 * | 5/2006 | Katsuumi | B41J 2/16532 347/29 |
| 7,431,422 | B2 * | 10/2008 | Asanuma | B41J 2/16535 347/29 |
| 8,118,396 | B2 * | 2/2012 | Umeda | B41J 2/16588 347/33 |
| 8,489,204 | B2 * | 7/2013 | Arcot-Krishnamurthy | A61B 5/02028 600/508 |
| 8,657,404 | B2 * | 2/2014 | Nishida | B41J 2/16508 347/29 |
| 9,227,408 | B2 * | 1/2016 | Sugimoto | B41J 2/16517 |

FOREIGN PATENT DOCUMENTS

| | | |
|---|---|---|
| JP | 2005-104162 | 4/2005 |
| JP | 2006-168177 | 6/2006 |
| JP | 2012-153128 | 8/2012 |

* cited by examiner

*Primary Examiner* — Anh T.N. Vo
(74) *Attorney, Agent, or Firm* — Frommer Lawrence & Haug LLP

(57) ABSTRACT

There is provided a liquid jetting apparatus including: a liquid jetting head including first and second nozzles from which the first and second liquids are jetted, respectively; a head driving unit; a flushing receiving part including first and second landing positions; and a controller. The controller causes the first and second liquids to be jetted from the first and second nozzles such that the first and second liquids land on the first and second landing positions respectively, in a case that a flushing process is performed in a state that a liquid-jetting process is performed. The controller controls the liquid jetting head to move during a period between jetting of the first and liquids land on the second landing position, in the case that the flushing process is performed in a state that the liquid-jetting process is not performed.

28 Claims, 9 Drawing Sheets

LIQUID JETTING APPARATUS

CROSS REFERENCE TO RELATED APPLICATION

The present application claims priority from Japanese Patent Application No. 2014-202353 filed on Sep. 30, 2014, the disclosure of which is incorporated herein by reference in its entirety.

BACKGROUND

1. Field of the Invention

The present teaching relates to a liquid jetting apparatus configured to jet liquid.

2. Description of the Related Art

As a liquid jetting apparatus configured to jet liquid from nozzles, there is conventionally known an ink-jet printer which performs printing on a recording sheet by jetting ink to the recording sheet from nozzles of an ink-jet head. The ink-jet printer generally performs the printing on the recording sheet by jetting the ink from the nozzles while reciprocatively moving the ink-jet head in a direction orthogonal to a sheet conveyance direction of the recording sheet. This ink-jet printer performs flushing, in which the ink is jetted from the nozzles to a flushing receiving part, in order to prevent the drying of ink in the nozzles, etc. The flushing receiving part includes, for example, an absorbing member absorbing the ink which landed thereon and a guide member having a slope for allowing the ink which landed thereon to slide down.

When different types inks having different solidification properties are used for the liquid jetting apparatus, easily-solidifying ink may adhere to and solidify on the surface of the flushing receiving part. In this situation, when the next flushing is performed with the ink solidified on the surface of the flushing receiving part, the easily-solidifying ink jetted from the nozzles adheres to and solidifies on the ink solidified on the surface of the flushing receiving part. If this occurs repeatedly, the solidified ink accumulates on the surface of the flushing receiving part. The accumulation of the solidified ink causes such a problem that the lower surface of the ink-jet head is brought into contact with the ink accumulated on the surface of the flushing receiving part during the movement of the ink-jet head.

In order to solve the above problem, there has been conventionally used the following another ink-jet printer, wherein the flushing is performed so that easily-solidifying black ink at first lands on a flushing receiving part (slope member); after that, the ink-jet head moves; and then color inks, which are less likely to solidify than the black ink, land at the landing position of the black ink on the flushing receiving part. Mixing the black ink adhering to the flushing receiving part with the color inks prevent the solidification of the black ink, and consequently prevent the accumulation of the black ink. The flushing includes a case in which the ink is jetted with the ink-jet head stopped and a case in which the ink is jetted with the ink-jet head moved.

SUMMARY

Regarding the another ink-jet printer described above, when the ink is jetted with the ink-jet head stopped, black ink is at first jetted in a state that the ink-jet head moved from a predetermined position is stopped; the ink-jet head is slightly moved; and color inks are jetted in a state that the ink-jet head is stopped. That is, the ink-jet head is stopped twice, which takes a long time for the flushing. Therefore, when the flushing is performed in a state that printing is performed, the printing time lengthens. On the other hand, when the ink is jetted with the ink-jet head moved, the time for the flushing can be shorter than the above case. However, when the flushing is performed by jetting a large amount of ink (e.g., the flushing after a suction purge), the ink-jet head is required to move at low velocity so as to allow black ink and color inks to land on the same position. Thus, the flushing needs a certain amount of time. Namely, the flushing performed in the state that the printing is performed makes the printing time longer.

In view of the above, an object of the present teaching is to provide a liquid jetting apparatus which is capable of preventing the solidification and accumulation of liquid which landed on a flushing receiving part without increasing the time for a jetting process in which the liquid is jetted to a medium such as a recording sheet.

According to a first aspect of the present teaching, there is provided a liquid jetting apparatus configured to jet first liquid and second liquid on a medium, including:

- a liquid jetting head including a first nozzle from which the first liquid is jetted and a second nozzle which is aligned with the first nozzle in a first direction and from which the second liquid is jetted, the second liquid being more likely to solidify than the first liquid;
- a head driving unit configured to move the liquid jetting head in the first direction;
- a flushing receiving part including a first landing position and a second landing position aligned in the first direction; and
- a controller configured to:
  - control the liquid jetting head and the head driving unit to perform a liquid-jetting process in which the first and second liquids are respectively jetted from the first and second nozzles toward the medium;
  - control the liquid jetting head and the head driving unit to perform a flushing process in which the first and second liquids are respectively jetted from the first and second nozzles toward the flushing receiving part;
  - control the liquid jetting head and the head driving unit to jet the first and second liquids from the first and second nozzles respectively such that the first and second liquids land on the first and second landing positions respectively during jetting periods of the first and second liquids at least a part of which overlap with each other, in a case that the flushing process is performed in a state that the liquid-jetting process is performed; and
  - control the liquid jetting head to move during a period between jetting of the first liquid from the first nozzles and jetting of the second liquid from the second nozzles such that the first and second liquids land on the second landing position, in the case that the flushing process is performed in a state that the liquid-jetting process is not performed.

In the present teaching, the second liquid which is more likely to solidify is allowed to land on the second landing position during the flushing process performed in the state that the jetting process is performed. The first liquid which is less likely to solidify than the second liquid is allowed to land on the second landing position during the flushing process performed in the state that the jetting process is not performed. Thus, even when the second liquid is adhering to the second landing position, the second liquid adhering to the second landing position can be dissolved in the first liquid and is allowed to flow or slide down. This prevents the solidification and accumulation of the second liquid on the second landing position. Regarding the flushing process performed in the state that the jetting process is not performed, the liquid jetting head moves during a period between jetting of the first liquid from the first nozzles and jetting of the second liquid from the second nozzles. Thus, this flushing process takes time. This flushing process, however, is performed in the state that the jetting process is not performed. Thus, the jetting process is unsusceptible to the flushing process. Regarding the flushing process performed in the state that the jetting process is performed, the first and second liquids are jetted from the first and second nozzles to land on the first and second landing positions during jetting periods of the first and second liquids which at least partially overlap with each other. Thus, in a case that the first and second liquids are jetted with the liquid jetting head stopped, the liquid jetting head is not required to move during the jetting of the first and second liquids. This reduces the time for the flushing process. In a case that the first and second liquids are jetted with the liquid jetting head moved, the first and second liquids are not required to land on the same position. This increases the moving speed of the liquid jetting head and reduces the time for the flushing process. Therefore, the time for the jetting process is prevented from lengthening. In the present teaching, the wording "the controller controls the liquid jetting head to move during a period between jetting of the first liquid from the first nozzles and jetting of the second liquid from the second nozzles" includes not only the case in which the second liquid is jetted from the second nozzles after jetting of the first liquid from the first nozzles but also the case in which the first liquid is jetted from the first nozzles after jetting of the second liquid from the second nozzles.

According to a second aspect of the present teaching, there is provided a liquid jetting apparatus configured to jet a first liquid and a second liquid on a medium, including:

- a liquid jetting head including a first nozzle from which the first liquid is jetted and a second nozzle which is aligned with the first nozzle in a first direction and from which the second liquid is jetted, the second liquid being more likely to solidify than the first liquid;
- a head driving unit configured to move the liquid jetting head in the first direction;
- a flushing receiving part including a first landing position and a second landing position aligned in the first direction; and
- a controller configured to:
  - control the liquid jetting head and the head driving unit to perform a liquid-jetting process in which the first and second liquids are respectively jetted from the first and second nozzles toward the medium;
  - control the liquid jetting head and the head driving unit to perform a flushing process in which the first and second liquids are jetted from the first and second nozzles toward the flushing receiving part;
  - control the liquid jetting head and the head driving unit to jet the first and second liquids from the first and second nozzles respectively such that the first and second liquids land on the first and second landing positions respectively, with the liquid jetting head stopped at a predetermined jetting position, in a case that the flushing process is performed in a state that the liquid-jetting process is performed; and
  - control the liquid jetting head to move during a period between jetting of the first liquid from the first nozzles and jetting of the second liquid from the second nozzles such that the first and second liquids land on the second landing position, in the case that the flushing process is performed in a state that the liquid-jetting process is not performed.

In the present teaching, the second liquid which is more likely to solidify is allowed to land on the second landing position during the flushing process performed in the state that the jetting process is performed. The first liquid which is less likely to solidify than the second liquid is allowed to land on the second landing position during the flushing process performed in the state that the jetting process is not performed. Thus, even when the second liquid is adhering to the second landing position, the second liquid adhering to the second landing position can be dissolved in the first liquid and is allowed to flow or slide down. This prevents the solidification and accumulation of the second liquid on the second landing position. Regarding the flushing process performed in the state that the jetting process is not performed, the liquid jetting head moves during a period between jetting of the first liquid from the first nozzles and jetting of the second liquid from the second nozzles. Thus, this flushing process takes time. This flushing process, however, is performed in the state that the jetting process is not performed. Thus, the jetting process is unsusceptible to the flushing process. Regarding the flushing process performed in the state that the jetting process is performed, the first and second liquids are jetted from the first and second nozzles to land on the first and second landing positions respectively, with the liquid jetting head stopped at the predetermined jetting position. Since the liquid jetting head does not move during the jetting of the first and second liquids, the time for the flushing process can be reduced. Therefore, the time for the jetting process is prevented from lengthening. In the present teaching, the wording "the controller controls the liquid jetting head to move during a period between jetting of the first liquid from the first nozzles and jetting of the second liquid from the second nozzles" includes not only the case in which the second liquid is jetted from the second nozzles after jetting of the first liquid from the first nozzles but also the case in which the first liquid is jetted from the first nozzles after jetting of the second liquid from the second nozzles.

DESCRIPTION OF THE EMBODIMENTS

Figure 1:
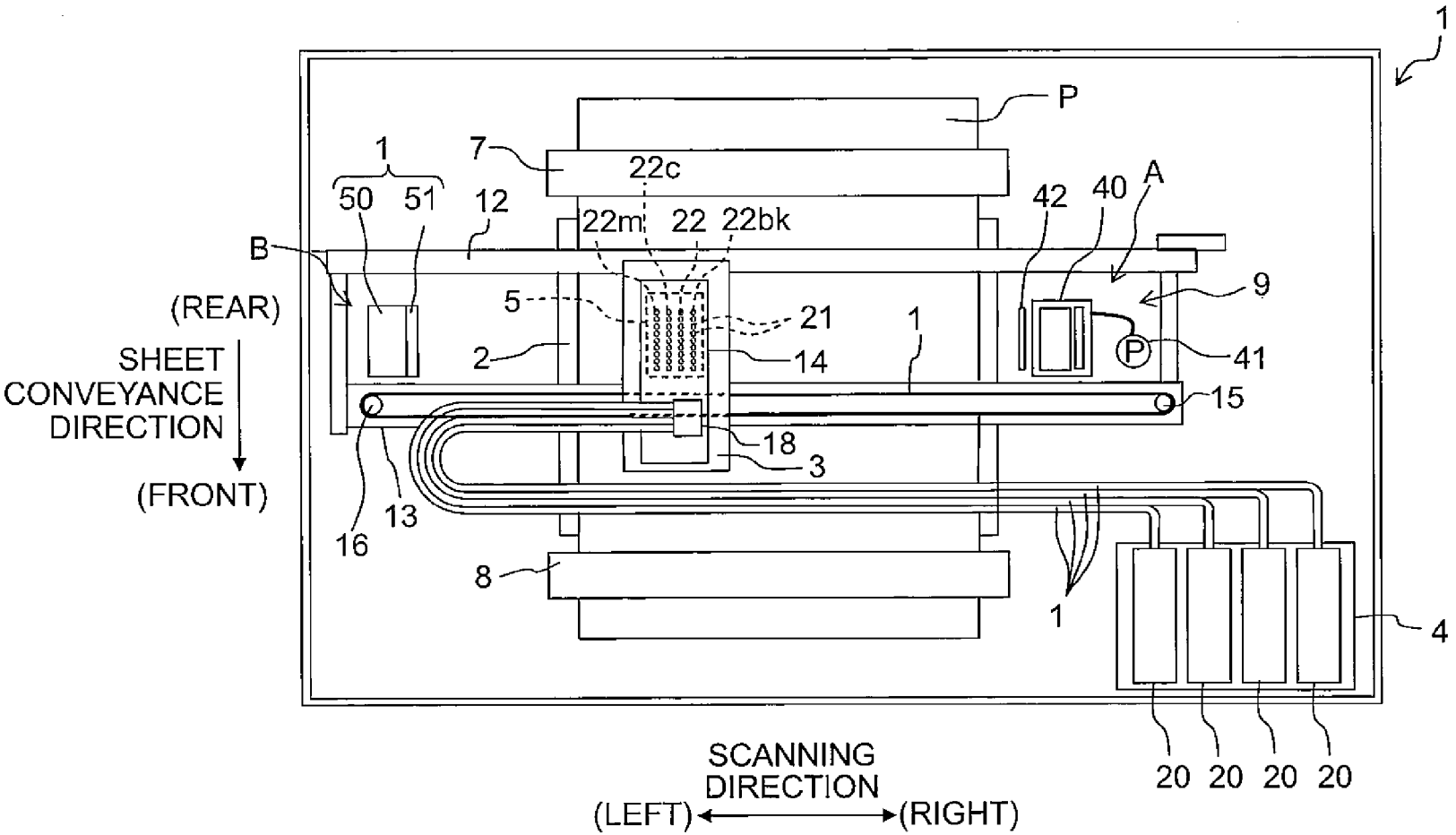
FIG. 1 is a schematic configuration diagram of a printer in accordance with an embodiment of the present teaching.

Subsequently, an explanation will be made about an embodiment of the present teaching. As depicted in FIG. 1, a printer 1 (a liquid jetting apparatus of the present teaching) includes a platen 2, a carriage 3, a sub tank 4, an ink-jet head 5, a holder 6, a feed roller 7, a discharge roller 8, a maintenance unit 9, a flushing receiving part 10, a controller 11 (see FIG. 2), and the like. The front, rear, left, and right directions depicted in FIG. 1 are defined as "front" "rear", "left", and "right" of the printer 1, respectively. Further, the front side with respect to the paper surface of FIG. 1 is defined as "up" and the back side with respect to the paper surface is defined as "down".

A recording sheet P (a medium of the present teaching) as a recording medium is placed on the upper surface of the platen 2. Two guide rails 12, 13 are provided above the platen 2. The guide rails 12, 13 extend parallel to the left-right direction of FIG. 1 (hereinafter also referred to as a scanning direction).

The carriage 3 is attached to the two guide rails 12, 13 to be movable within an area facing the platen 2 along the two guide rails 12, 13 in the scanning direction. A drive belt 14 is connected to the carriage 3. The drive belt 14 is an endless belt wound and applied between two pulleys 15, 16. The pulley 15 is connected to a carriage drive motor 17 (see FIG. 2, a head drive unit of the present teaching). The pulley 15, which is driven to rotate by the carriage drive motor 17, moves the drive belt 14. This allows the carriage 3 to reciprocate in the scanning direction.

The carriage 3 carries the sub tank 4. A tube joint 18 is provided on the upper surface of the sub tank 4, and four ink supply tubes 19 connected to the holder 6 are connected to the tube joint 18. Four ink cartridges 20 are exchangeably installed to the holder 6. The four ink cartridges 20 contain inks of four colors (black, yellow, cyan, and magenta) respectively. The inks in the four ink cartridges 20 are supplied to the sub tank 4 via the four ink supply tubes 19 respectively.

In this embodiment, a pigment ink is used for the black ink, and dye inks are used for the inks of three colors of yellow, cyan, and magenta. Regarding the pigment ink, a pigment component is dispersed as particles in a solvent without being dissolved in the solvent such as a surfactant and/or water. When the pigment ink is jetted from the nozzles 21 on a recording paper P, the particles of the pigment component remain on the surface of the recording paper P and the particles themselves form the color. Regarding the dye ink, the dye component is dissolved in a solvent such as a surfactant and/or water. When the dye ink is jetted from the nozzles 21 on the recording paper P, the solvent, in which the dye component is dissolved, is permeated into the recording paper P, thereby forming the color. In general, the solvent used for the pigment ink is highly-volatile, and thus the pigment ink solidifies more easily than the dye ink. Further, the pigment ink has a redispersion property lower than that of the dye ink. The redispersion property means, for example, the solubility and dispersion property of a solid matter, in the water-based ink, generated after the water-based ink is once evaporated to dry with resultant solid matter, the solubility and dispersion property being those of when the solid matter is then newly brought in contact with the water-based ink.

The ink-jet head 5 is installed to a lower part of the sub tank 4. The nozzles 21 are provided on the lower surface of the ink-jet head 5. The inks supplied from the sub tank 4 are jetted from the ink-jet head 5. The lower surface, of the ink-jet head 5, formed with the nozzles 21 is referred to as "ink jetting surface 5*a*" (a liquid jetting surface of the present teaching).

Figure 3:
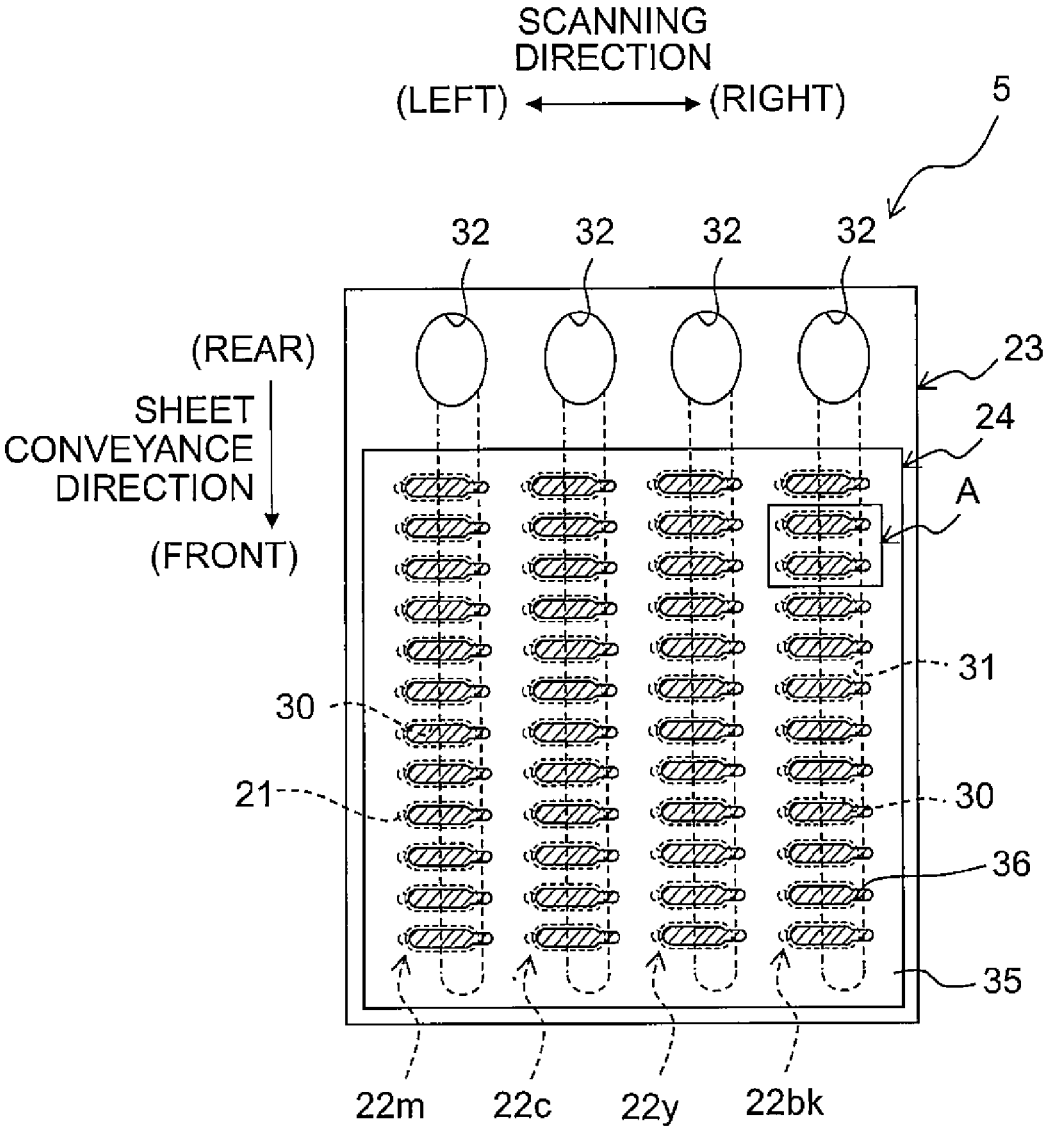
FIG. 3 is a plan view of an ink-jet head.
Figure 4A:
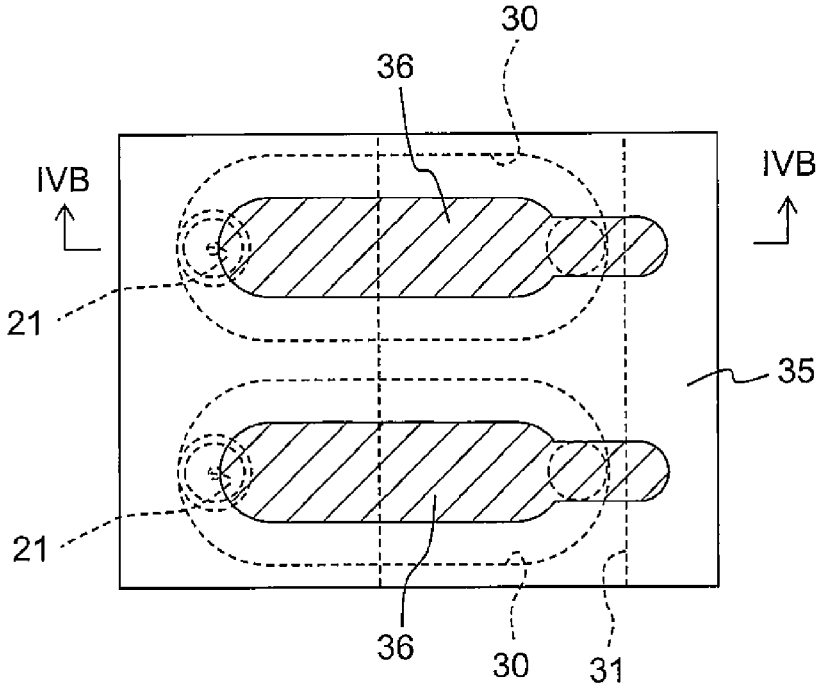
FIG. 4A is an enlarged view of the portion A in FIG. 3.
Figure 4B:
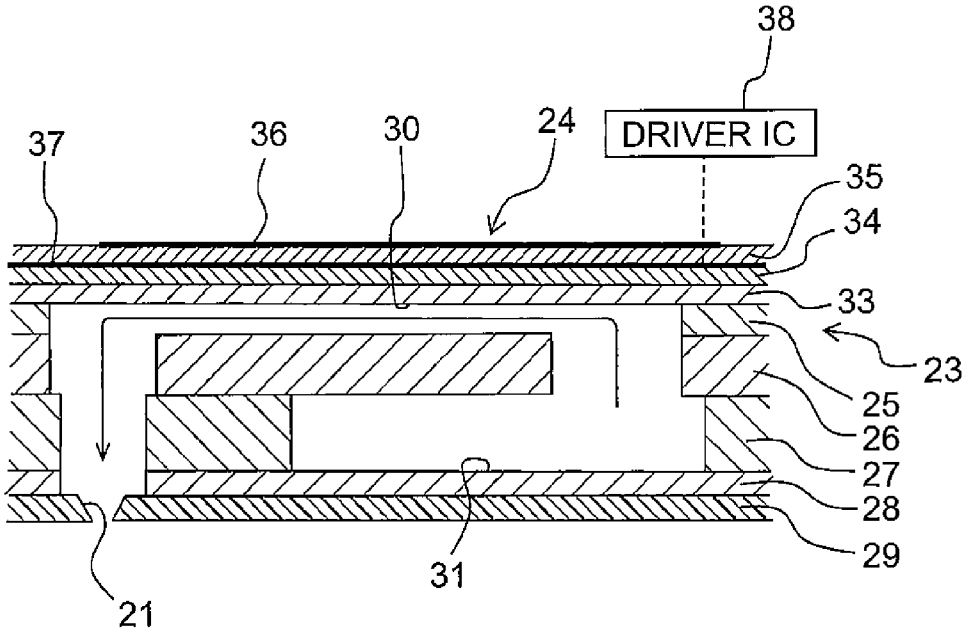
FIG. 4B is a cross-sectional view taken along the line IVB-IVB in FIG. 4A.

Here, a concrete structure of the ink-jet head 5 will be explained. As depicted in FIGS. 3 and 4, the ink-jet head 5 includes a channel unit 23 and a piezoelectric actuator 24.

The channel unit 23 is formed of five plates 25 to 29 stacked on top of each other. The lowermost plate 29 of the five plates 25 to 29 is a nozzle plate formed with the nozzles 21. On the other hand, channels, such as pressure chambers 30 and manifolds 31, are formed in the remaining four plates 25 to 28 disposed on the upper side of the lowermost plate 29. The pressure chambers 30 and manifolds 31 communicate with the nozzles 21.

As depicted in FIG. 3, the nozzles 21 are formed on the ink jetting surface 5*a*, which is the lower surface of the channel unit 23. The nozzles 21 form four nozzle rows 22*bk*, 22*y*, 22*c*, and 22*m*, which are arranged in the scanning direction to correspond to inks of black, yellow, cyan, and magenta, respectively. The four nozzle rows 22*bk*, 22*y*, 22*c*, and 22*m* are disposed on the ink jetting surface 5*a* from the right side to the left side in this order. The inks of black, yellow, cyan, and magenta are jetted from the four nozzle rows 22*bk*, 22*y*, 22*c*, and 22*m*, respectively.

The channel unit 23 includes the pressure chambers 30 communicating with the nozzles 21 respectively. Four rows of pressure chambers 30 are formed corresponding to the four nozzle rows. Further, four manifolds 31 are formed in the channel unit 23. The four manifolds 31 extend in the sheet conveyance direction. The four inks of black, yellow, cyan, and magenta are supplied to the four pressure chamber rows through the four manifolds 31, respectively. The four manifolds 31 are connected to four ink supply holes 32 formed on the upper surface of the channel unit 23. The four ink supply holes 32 are connected to the sub tank 4, and the four inks are supplied from the sub tank 4.

As depicted in FIGS. 3 and 4, the piezoelectric actuator 24 includes a vibration plate 33, piezoelectric layers 34, 35, individual electrodes 36, and a common electrode 37. The vibration plate 33 is joined to the upper surface of the channel unit 23 to cover the pressure chambers 30. The two piezoelectric layers 34, 35 are stacked on the upper surface of the vibration plate 33. The individual electrodes 36 are disposed on the upper surface of the upper piezoelectric layer 35 to face the pressure chambers 30 respectively. The common electrode 37 is disposed between the piezoelectric layers 34, 35 to extend across the pressure chambers 30.

When a drive signal is supplied from a driver IC 38 to a certain individual electrode 36 upon the receipt of a signal from the controller 11, piezoelectric distortion occurs at a part, of the upper piezoelectric layer 35, facing the pressure chamber 30. This deforms and bends the vibration plate 30. In this situation, the volume of the pressure chamber 30 changes to decrease, thereby applying the pressure to the ink in the pressure chamber 30. Accordingly, the ink is jetted from the nozzle 21.

Figure 2:
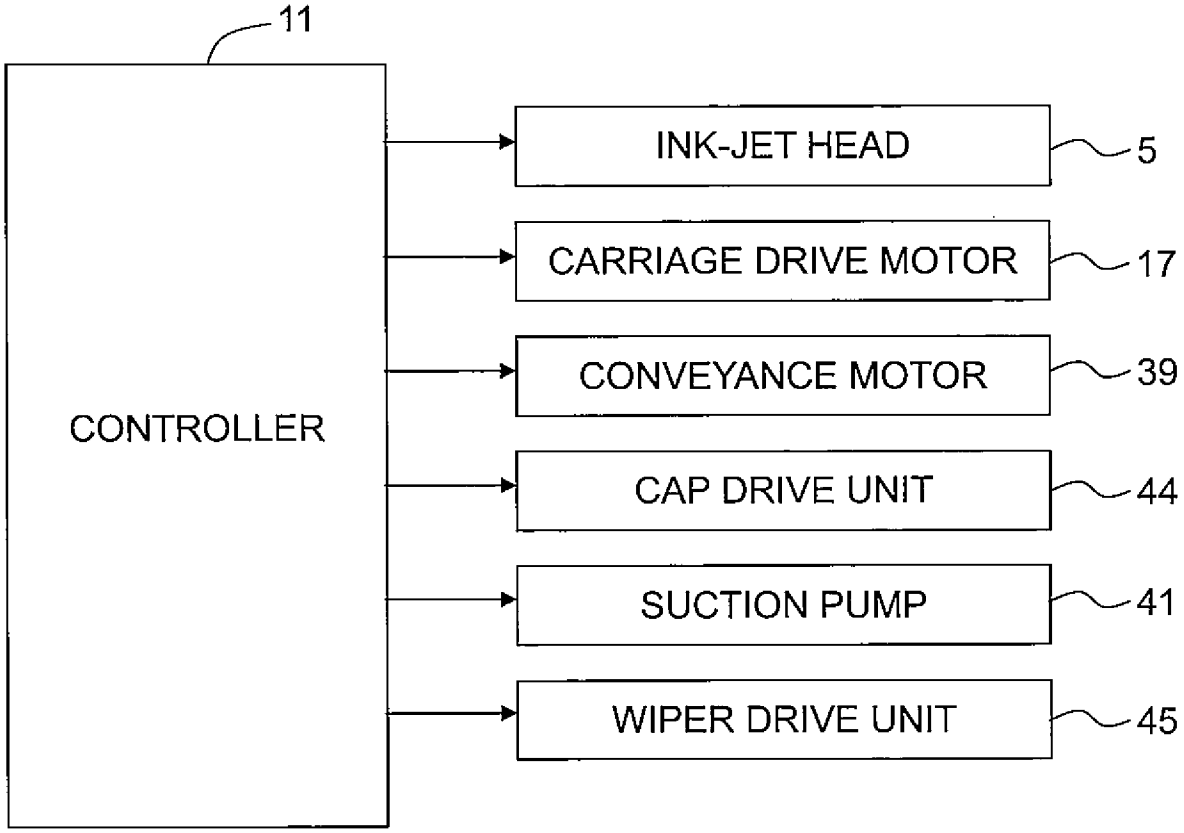
FIG. 2 is a block diagram schematically depicting an electrical configuration of the printer.

With reference to FIG. 1, the feed roller 7 and the discharge roller 8 are rotationally driven synchronously with each other by means of a conveyance motor 39 (see FIG. 2). The cooperation of the feed roller 7 and the discharge roller 8 conveys the recording sheet P on the platen 2 frontward (hereinafter also referred to as "sheet conveyance direction"). The printer 1 performs printing on the recording sheet P by jetting the ink from the ink-jet head 5 reciprocating in the scanning direction while conveying the recording sheet P in the sheet conveyance direction by means of the feed roller 7 and the discharge roller 8.

The printer 1 according to this embodiment performs printing on the recording sheet P by repeatedly performing the operation in which the recording sheet P is conveyed in the sheet conveyance direction by a predetermined conveyance amount and the operation in which the ink is jetted from the nozzles 21 while the ink-jet head 5 is moving forward or backward. A single operation, in which the ink is jetted from the nozzles 21 while the ink-jet head 5 is moving forward or backward, is referred to as "one pass".

The maintenance unit 9 is disposed on the right end of a movement area of the ink-jet head 5 in the scanning direction (hereinafter also referred to as "maintenance position A"). The maintenance unit 9 includes a suction cap 40, a suction pump 41, a wiper 42, and the like. The maintenance unit 9 performs the operation, such as the suction purge, for maintaining and recovering the jetting performance of the nozzles 21 of the ink-jet head 5. Details of the maintenance unit 9 will be described later.

The flushing receiving part 10 is disposed on the left end of the movement area of the ink-jet head 5 in the scanning direction (hereinafter also referred to as "flushing position B"). The flushing receiving part 10 includes an ink absorbing member 50 and a guide member 51. The ink jetted from the nozzles 21 lands on the flushing receiving part 10 during the flushing of the ink-jet head 5. Details of the flushing receiving part 10 will be described later.

The controller 11 (a control unit of the present teaching) includes Read Only Memory (ROM), Random Access Memory (RAM), and Application Specific Integrated Circuit (ASIC) including various control circuits, and the like. The controller 11 controls the ASIC to perform various processes such as the printing onto the recording sheet P in accordance with programs stored in the ROM. The controller 11 controls the ink-jet head 5, the carriage drive motor 17, the conveyance motor 39, and the like on the basis of a printing command inputted from an external device such as a personal computer, to perform the printing of an image or the like on the recording sheet P (a printing process, a jetting process of the present teaching). The controller 11 controls, for example, the suction pump 41 and a cap drive unit 44 as described later to perform the suction purge (a purge process of the present teaching). The controller 11 controls the carriage drive motor 17 and a wiper drive unit 45 as described later to perform the wiping of the ink jetting surface 5*a* by use of the wiper 42. The controller 11 controls the ink-jet head 5 and the carriage drive motor 17 to perform the flushing (a flushing process of the present teaching).

Next, the detailed structure of the maintenance unit 9 will be explained. As depicted in FIGS. 1 and 5A to 5D, the maintenance unit 9 includes the suction cap 40, the suction pump 41, the wiper 42, and the like. Each of the suction cap 40 and the suction pump 41 is a purge mechanism of the present teaching.

Figure 5A:
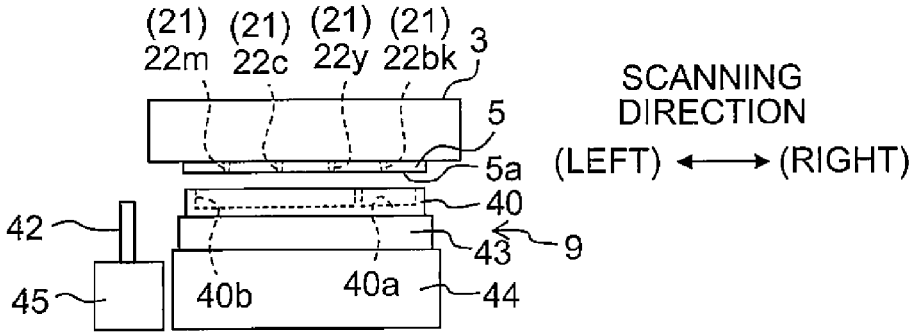
FIGS. 5A to 5D are illustrative views each illustrating the operation of a maintenance unit.

The suction cap 40 is disposed to face the ink jetting surface 5*a* when the ink-jet head 5 is in the maintenance position A. As depicted in FIG. 5A, the suction cap 40 is held by a cap lift holder 43 positioned under the suction cap 40. The cap lift holder 43 is driven to move upward and downward by means of the cap drive unit 44 including a motor and the like.

The suction cap 40 includes a first cap 40*a* and a second cap 40*b* which are partitioned or defined by a partition wall. The first cap 40*a* and the second cap 40*b* include unillustrated connection ports respectively. The two connection ports are connected to the suction pump 41 via an unillustrated switching unit. The swinging unit can selectively switch a state in which the connection port of the first cap 40*a* communicates with the suction pump 41 and a state in which the connection port of the second cap 40*b* communicates with the suction pump 41.

Figure 5B:
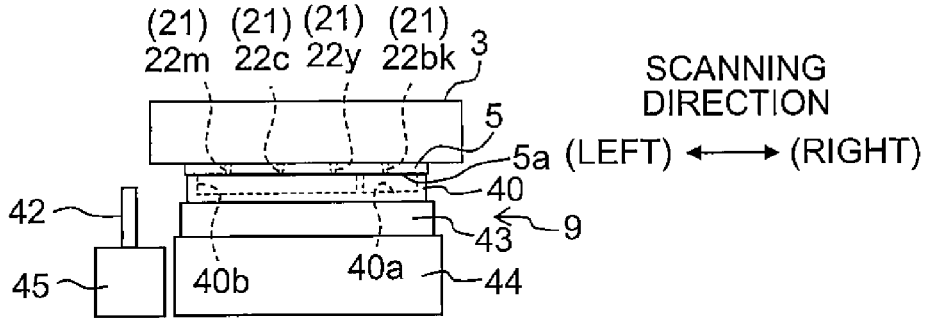

When the cap lift holder 43 is moved upward by the cap drive unit 44 with the ink-jet head 5 being in the maintenance position A as depicted in FIGS. 5A and 5B, the suction cap 40 is brought into tight contact with the ink jetting surface 5*a* of the ink-jet head 5. This allows the nozzle row 22*bk* from which the black ink is jetted to be covered with the first cap 40*a*, and at the same time allows three nozzle rows 22*y*, 22*c*, and 22*m* from which inks of three colors are jetted to be covered with the second cap 40*b*. In this situation, when the suction pump 41 connected to the suction cap 40 is driven, the pressure in the first cap 40*a* or the second cap 40*b* is reduced, thereby sucking and discharging the black ink or inks of three colors in the ink-jet head 5 from the nozzles 21 into the suction cap 40. Accordingly, foreign substances, air bubbles, high viscosity inks due to drying, etc., in the ink-jet head 5 are discharged from the ink-jet head 5 (this operation is called the suction purge).

The suction purge is performed, for example, at the timing immediately after power is applied to the printer 1, the timing immediately after the printer 1 has recovered from a sleep state, and the timing at which a purge command is inputted by a user. In this embodiment, the suction purge immediately after power is applied to the printer 1 is not always performed every time power is applied to the printer 1. This suction purge is performed only when a predetermined condition is satisfied. In addition to the above timings, the suction purge may be performed regularly, namely at a predetermined time interval, when no printing is being performed.

Figure 5C:
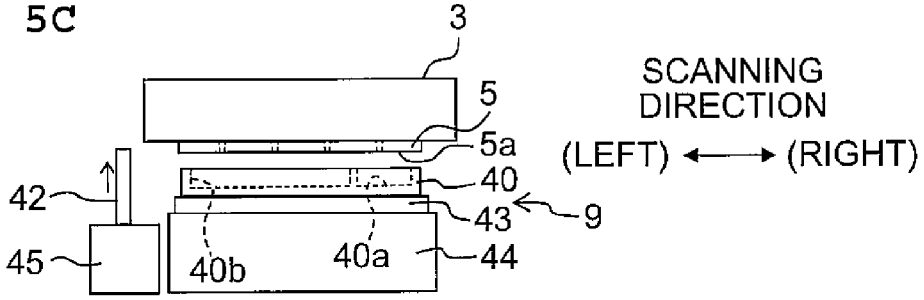
Figure 5D:
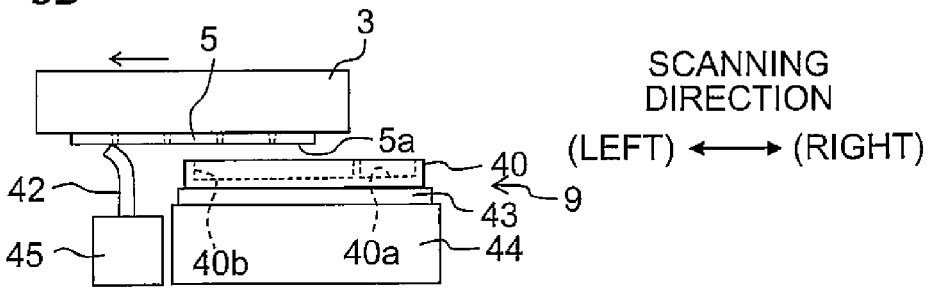

The wiper 42 is a plate-like member formed of a flexible material such as rubber, synthetic resin, or the like. The wiper 42 is disposed on the left side of the suction cap 40 to be parallel to the up-down direction and the front-rear direction. The length of the wiper 42 in the front-rear direction is the same as or longer than the length of the ink jetting surface 5*a* in the front-rear direction. The wiper 42 is driven to move upward and downward by the wiper drive unit 45 including a motor and the like. As depicted in FIGS. 5C and 5D, when the ink-jet head 5 moves in the scanning direction in a state that the front end of the wiper 42 is positioned above the ink jetting surface 5*a* of the ink-jet head 5, the wiper 42 moves relative to the ink-jetting surface 5*a* to wipe the ink-jetting surface Sa.

After the above suction purge, the wiping of the ink jetting surface 5*a* is performed by use of the wiper 42. The timing at which the wiper 42 wipes the ink jetting surface 5*a* is not limited to the timing after the suction purge. For example, the ink may be wiped off after printing is performed by jetting the ink on the recording sheet P.

Subsequently, an explanation will be made about the detailed structure of the flushing receiving part 10. As depicted in FIGS. 1, 6, and 7A and 7B, the flushing receiving part 10 includes the ink absorbing member 50 and the guide member 51 which are disposed in the scanning direction. The lengths of the ink absorbing member 50 and the guide member 51 in the sheet conveyance direction are substantially the same as the length, of the area formed with the nozzles 21, in the sheet conveyance direction.

The ink absorbing member 50 is made of an ink absorbable material (for example, a porous material or fiber material). The length of the ink absorbing member 50 in the scanning direction is longer than the length, of the area formed with three nozzle rows 22*y*. 22*c*, and 22*m* from which the inks of three colors are jetted respectively, in the scanning direction. The inks of three colors land on the upper surface of the ink absorbing member 50 during the flushing.

The guide member 51 is disposed on the right side of the ink absorbing member 50. The guide member 51 extends vertically upward from its lower end to its intermediate portion and extends rightward and upward from the intermediate portion to the upper end, thereby forming a slope 52. The inks jetted from the nozzles 21 land on the slope 52 during the flushing of the ink-jet head 5. The black ink and the inks of three colors land on the guide member 51. A waste tank 53 is disposed below the guide member 51. The inks which landed on the slope 52 slide down the slope 52 and are collected into the waste tank 53.

The slope 52 is inclined moderately, this is because, when the inclination angle of the slope 52 is too steep, the inks jetted from the nozzles 21 could have difficulty in landing on the slope 52; on the other hand, when the inclination angle of the slope 52 is too gentle, the inks jetted from the nozzles 21 would fail to slide down, and then could dry to be accumulated on the slope 52. Specifically, the slope 52 can have an inclination angle in a range of about 40 degrees to about 60 degrees. Further, the slope 52 has moderate water repellency, this is because, when the water repellency of the slope 52 is too high, the inks are less likely to adhere to the slope 52, scatter freely, and would not form ink mist; on the other hand, when the water repellency of the slope 52 is too low, the inks adhering to the slope 52 could spread thereover excessively, would fail to slide down, and could dry to be accumulated on the slope 52. The moderate water repellency can be obtained by, for example, a water-repellent treatment using fluorine resin, etc.

The ink-jet head 5 performs the operation called flushing in which the inks are jetted a plurality of times at proper timings from the nozzles 21 toward the flushing receiving part 10. The flushing may be performed when the ink-jet head 5 is being stopped or is moving in the scanning direction.

The flushing may be performed when no printing is being performed and when the printing is being performed. The flushing performed when no printing is being performed may be performed, for example, at the timing after the suction purge (more specifically, after the wiping of ink by use of the wiper 42), the timing immediately after power is applied to the printer 1, the timing after the printer 1 has recovered from a long sleep state, and a case in which a predetermined time has elapsed after the most recently suction purge. Further, the flushing may be performed regularly, every time a predetermined time (for example, 72 hours) elapses, under the condition that no printing is being performed. In the present description, the flushing performed immediately after power is applied to the printer 1 does not include the flushing, which is performed after the suction purge performed immediately after power is applied to the printer 1. Further, the flushing performed immediately after power is applied to the printer 1 is not always performed every time power is applied to the printer 1, but this flushing is performed only when a predetermined condition is satisfied.

The flushing performed when the printing is being performed may be performed after a printing command is inputted to the controller 11 until the ink-jet head 5 starts the printing (ink jetting operation) and after the ink-jet head 5 starts the printing until the printing is completed. As an example of the latter, the flushing may be performed every time the pass is performed a predetermined number of times. When printing is performed for recording sheets P during a single printing process, the flushing may be performed after the printing is performed for a predetermined number of recording sheets P before the printing for the next recording sheet is started. In this description, "when the printing is being performed" means a period of time after the printing command is inputted to the controller 11 until the ink-jet head 5 completes the printing. In the following, an explanation will be made about the purpose of the flushing.

Waste inks, which are discharged from the nozzles 21 during the suction purge and are adhering to the ink jetting surface 5*a*, are sucked into the nozzles 21 due to the back pressure in the ink-jet head 5, when the suction cap 40 is separated from the ink jetting surface 5*a*. The flushing performed after the suction purge prevents the inks in the nozzles 21 from being mixed with the waste inks. Further, the meniscuses of inks in the nozzles 21 might be unstable by performing the suction purge and the wiping of ink by use of the wiper 42 performed after the suction purge. The flushing performed after the wiping of ink, which is performed after the suction purge, can stabilize the meniscuses of inks in the nozzles 21, in addition to obtaining the above effect.

The solvent evaporates through openings in the nozzles 21 when the ink-jet head 5 is performing the printing. This dries inks (this increases the viscosity of inks). Although the nozzles 21 are covered with the suction cap 40 when the printer 1 is in the stop state, the suction cap 40 communicates with atmosphere. Thus, the inks in the nozzles 21 dry (the viscosity of the inks in the nozzles 21 increases). Flushings other than the flushing performed after the suction purge are performed to discharge the thickened inks from the nozzles 21.

The flushing performed after the ink-jet head 5 starts the printing includes a case in which ink(s) is/are jetted from nozzle row(s), of four nozzle rows 22*bk*, 22*y*. 22*c*, and 22*m*, which is/are not being used for the printing and a case in which inks are jetted from all of the four nozzle rows 22*bk*, 22*y*, 22*c*, and 22*m*. Regarding any other flushings than the above, inks are jetted from all of the four nozzle rows 22*bk*, 22*y*, 22*c*, and 22*m*.

The amounts of inks jetted from the nozzles 21 vary depending on the timing at which the flushing is performed. The flushing after the suction purge uses the largest amounts of inks jetted from the nozzles 21, the flushing performed after the ink-jet head 5 starts the printing uses the second largest amounts of inks jetted from the nozzles 21, and the flushing performed regularly uses the smallest amounts of inks jetted from the nozzles 21. In the flushing performed after the printing command is inputted before the printing is started, although the amounts of inks jetted from the nozzles 21 vary depending on the time elapsed after the last printing, the amounts of inks jetted from the nozzles 21 are smaller than the ink amounts jetted from the nozzles 21 during the flushing after the suction purge.

In the flushing performed after the suction purge, the amount of ink jetted from each of nozzle rows 22*y*, 22*c*, and 22*m* through which one of color inks is jetted is larger than the amount of the ink jetted from the nozzle row 22*bk* through which the black ink is jetted. This is because the three nozzle rows 22*y*. 22*c*, and 22*m* through which inks of three colors are jetted are covered collectively with the second cap 40*b* of the suction cap 40, and thus the color inks are more likely to be mixed with one another in the nozzles 21 than the nozzle row 22*bk* through which only the black ink is jetted.

On the other hand, in flushings other than the flushing performed after the suction purge, the amount of ink jetted from each of nozzle rows 22*y*, 22*c*, and 22*m* through which one of color inks is jetted is smaller than the amount of the ink jetted from the nozzle row 22*bk* through which the black ink is jetted. This is because the color inks which are dye inks are less likely to dry than the black ink which is the pigment ink.

In the printer 1 according to this embodiment, the landing positions of inks on the flushing receiving part 10 are different between the flushing performed when the printing is being performed and the flushing performed when no printing is being performed.

The flushing performed when the printing is being performed will be explained first. As described above, in the flushing performed after the ink-jet head 5 starts the printing, ink(s) may jetted from nozzle row(s), of four nozzle rows 22*bk*, 22*y*, 22*c*, and 22*m*, which is/are not being used for the printing. In the following, however, the case where inks are jetted from all of the four nozzle rows 22*bk*, 22*y*, 22*c*, and 22*m* will be explained.

Figure 6:
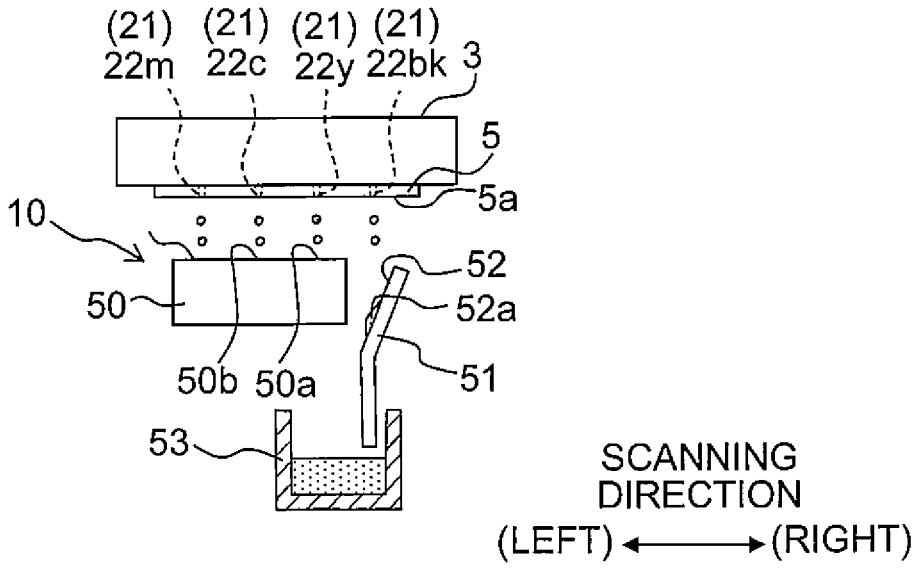
FIG. 6 is an illustrative view illustrating flushing performed when printing is being performed.
Figure 9:
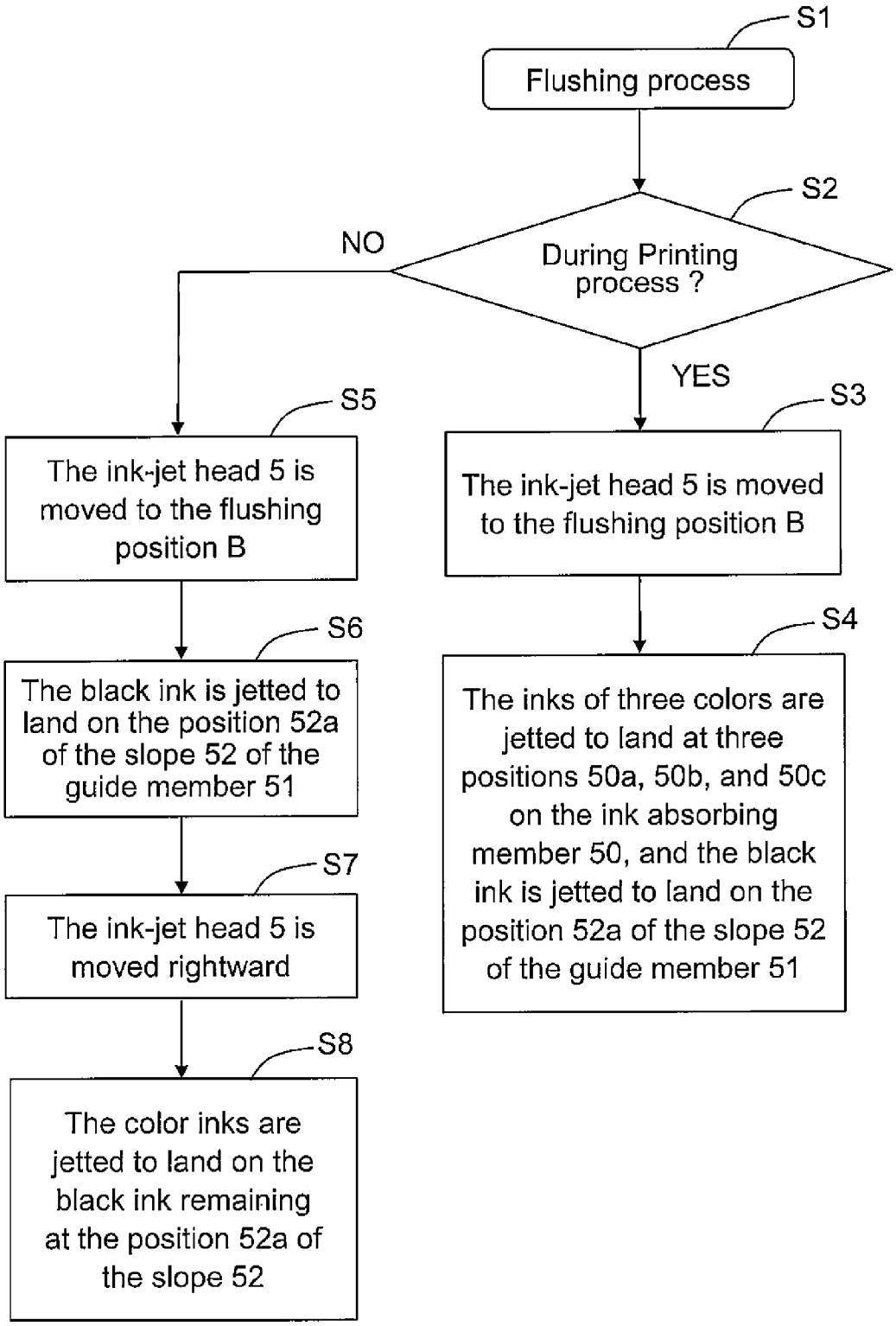
FIG. 9 depicts a flow chart indicating the flushing process.

As depicted in FIGS. 6 and 9, when a flushing command is input (S1) in the middle of the printing (S2=Yes), the controller 11 at first controls the carriage drive motor 17 to move the ink-jet head 5 to the flushing position B (S3). This allows three nozzle rows 22*y*, 22*c*, and 22*m* through which inks of three colors are jetted to face the ink absorbing member 50 and allows the nozzle row 22*bk* through which the black ink is jetted to face the slope 52 of the guide member 51. In this situation, the controller 11 controls the ink-jet head 5 to jet inks from four nozzle rows 22*bk*, 22*y*, 22*c*, and 22*m*. Here, the time during which the black ink is jetted from the nozzle row 22*bk* overlaps at least partially with each of the times during which each of the inks of three colors is jetted from one of three nozzle rows 22*y*, 22*c*, and 22*m*. The inks of three colors land at three positions 50*a*, 50*b*, and 50*c* (hereinafter referred to as landing positions 50*a*, 50*b*, and 50*c*, each of which corresponds to a first landing position of the present teaching) on the ink absorbing member 50 (S4). The black ink lands on a predetermined position 52*a* of the slope 52 of the guide member 51 (hereinafter referred to as a landing position 52*a* which corresponds to a second landing position of the present teaching) (S4).

Figure 7A:
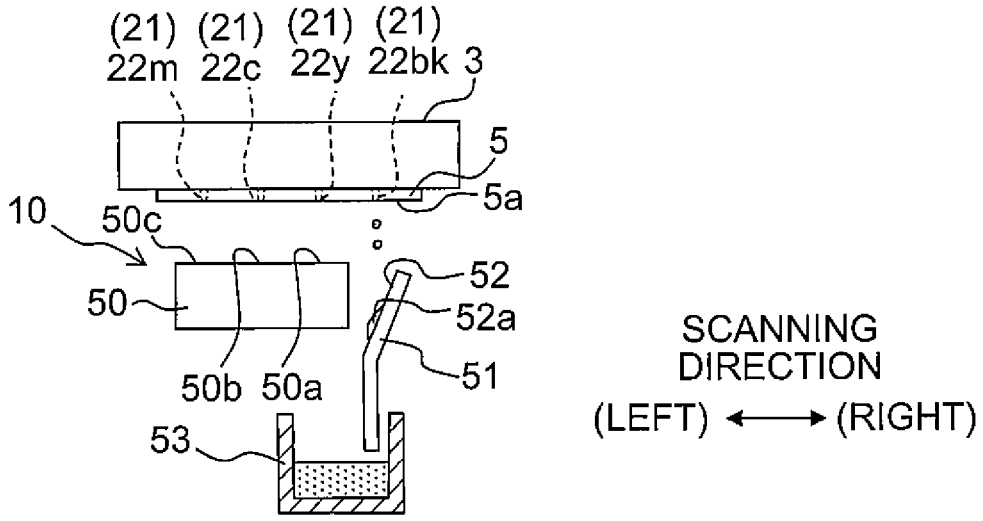
FIGS. 7A and 7B are illustrative views each illustrating flushing performed when no printing is being performed.

Next, an explanation will be made about the flushing performed when no printing is being performed. As depicted in FIG. 7A, when a flushing command is inputted with no printing performed (S2=NO), the controller 11 at first controls the carriage drive motor 17 to move the ink-jet head 5 to the flushing position B (S5). This allows three nozzle rows 22*y*, 22*c*, and 22*m* through which inks of three colors are jetted to face the ink absorbing member 50 and allows the nozzle row 22*bk* through which the black ink is jetted to face the slope 52 of the guide member 51. In this situation, the controller 11 controls the ink-jet head 5 to jet the ink from the nozzle row 22*bk* of four nozzle rows 22*bk*, 22*y*, 22*c*, and 22*m*, and thereby causing the black ink to land on the landing position 52*a* of the slope 52 of the guide member 51 (S6).

Figure 7B:
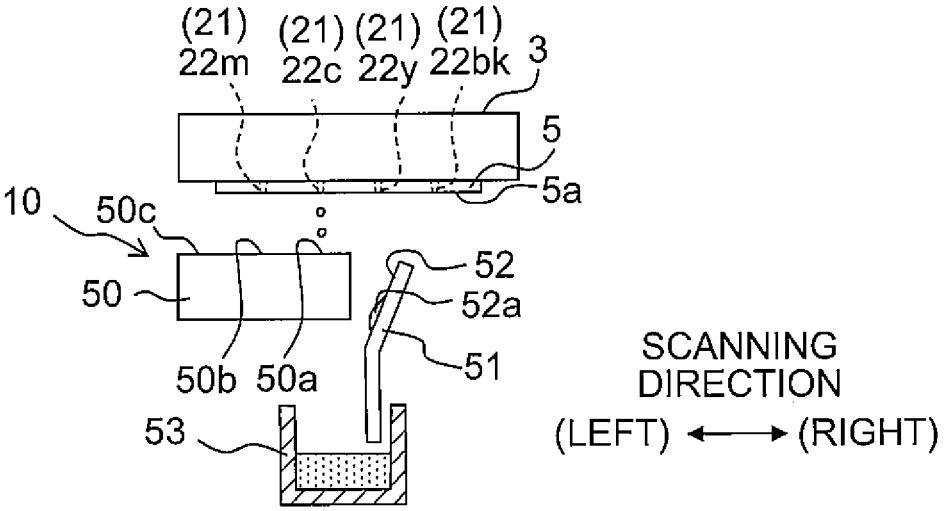

After that, as depicted in FIG. 7B, the controller 11 controls the ink-jet head 5 to move rightward (S7). This allows the nozzle row 22*y* from which the yellow ink is jetted to face the slope 52 of the guide member 51. In this situation, the yellow ink is jetted from the nozzle row 22*y* to land on the black ink remaining at the landing position 52*a* of the slope 52 (S8). Subsequently, the cyan ink and the magenta ink are jetted in this order to land at the landing position 52*a* on the slope 52 of the guide member 51 in a similar manner to the yellow ink (S8).

When each color ink as the dye ink lands on the ink absorbing member 50, each color ink is absorbed into the ink absorbing member 50 before it solidifies. Thus, each color ink is less likely to accumulate on the surface of the ink absorbing member 50. On the other hand, the black ink as the pigment ink is more likely to solidify than the dye ink. Thus, when the black ink lands on the ink absorbing member 50, its solvent and the like evaporates before the black ink is absorbed into the ink absorbing member 50. This could cause the solidification of the black ink on the surface of the ink absorbing member 50. If the black ink is jetted at the next flushing with the black ink solidified on the ink absorbing member 50, the black ink adheres to and accumulate on the solidified black ink during the next flushing. When this situation occurs repeatedly, the black ink solidifies on and accumulate on the ink absorbing member 50 one after another.

In view of the above, the black ink is made to land on the slope 52 of the guide member 51 in this embodiment. The black ink landing on the slope 52 slides down the slope 52. Thus, the black ink is less likely to accumulate as compared with the case in which the black ink lands on the ink absorbing member 50. However, a part of the black ink which landed on the slope 52 may remain on the slope 52 without sliding down. In such a case, the black ink remaining on the slope 52 of the guide member 51 could solidify before the next flushing is performed.

In order to deal with the above problem, in this embodiment, the color inks which are less likely to solidify than the black ink are made to land on the guide member 51 during the flushing performed when no printing is being performed. This can dissolve the black ink solidified on the slope 52 of the guide member 51 in the color inks to let the black ink flow. Therefore, it is possible to prevent the solidification and accumulation of the black ink on the slope 52 of the guide member 51.

In the flushing performed when no printing is being performed according to this embodiment, the black ink lands on the guide member 51 before landings of inks of three colors. Thus, not only the black ink which has already adhered to the guide member 51 but also the black ink which landed on the guide member 51 immediately before the landings of color inks are allowed to flow or slide down by the aid of the color inks. Therefore, it is possible to reliably prevent the solidification and accumulation of the black ink on the slope 52 of the guide member 51.

In the flushing performed when no printing is being performed, the ink-jet head 5 moves every time jetting of each of black, cyan, magenta, and yellow inks is completed. This allows the inks jetted from four nozzle rows 22*bk*, 22*y*. 22*c*, and 22*m* respectively to land on the same landing position 52*a*. Thus, the time required for the flushing is long. This flushing, however, is performed when no printing is being performed, and thus any problem such as a long user waiting time will not occur, even when the flushing takes a long time.

In the flushing performed when the printing is being performed, the black ink is jetted to land on the guide member 51 and inks of three colors are jetted to land on the ink absorbing member 50 so that the time during which the black ink is jetted from the nozzle row 22*bk* overlaps at least partially with each of the times during which each of the yellow, cyan, and magenta inks is jetted from one of three nozzle rows 22*y*, 22*c*, and 22*m*. Thus, when each of the inks is jetted with the ink-jet head 5 stopped, since the ink-jet head 5 is not required to move during jetting of each of the four inks, the time required for the flushing can be reduced as compared with the case in which both of the black ink and inks of three colors land on the guide member 51. Further, when each of the inks is jetted during the movement of the ink-jet head 5, since each of the inks is not required to land on the same position, the movement velocity of the ink-jet head 5 can be increased. Thus, it is possible to reduce the time required for the flushing as compared with the case in which both of the black ink and inks of three colors land on the guide member 51. Namely, the time required for the flushing can be shortened in both of the case in which the flushing is performed with the ink-jet head 5 stopped and the case in which the flushing is performed during the movement of the ink-jet head 5. This prevents increase in the time required for printing (including the time required for flushing).

In the flushing performed when no printing is being performed according to this embodiment, three color of inks are jetted from three nozzle rows 22*y*, 22*c*, and 22*m* to land on the guide member 51. This can dissolve the black ink adhering to the guide member 51 in the color inks more reliably so as to let the black ink flow, as compared with the case in which only one color ink is jetted to land on the guide member 51.

The amounts of inks jetted in the flushing performed when no printing is being performed are larger than the amounts of inks jetted in the flushing performed after a printing command is inputted before the ink-jet head 5 starts the printing. Thus, when all of the color inks are jetted to land on the guide member 51 in the flushing performed when no printing is being performed, the amounts of color inks landing on the guide member 51 are larger than the case in which all of the color inks are jetted to land on the guide member 51 in the flushing performed after the printing command is inputted before the ink-jet head 5 starts the printing. Therefore, the black ink adhering to the guide member 51 can be dissolved in the color inks more reliably and can slide down the guide member 51.

The preferred embodiment of the present teaching has been explained above. The present teaching, however, is not limited to the above embodiment. Various modifications may be made without departing from the claims. Further, modified embodiments as described later may be performed by appropriately combining them.

In the above embodiment, inks of three colors as the dye inks each correspond to a first liquid of the present teaching. The black ink as the pigment ink corresponds to a second liquid of the present teaching. The first and second liquids of the present teaching, however, are not limited to those, provided that the first liquid is less likely to solidify than the second liquid. For example, both of the first and second liquids may be dye inks.

In the above embodiment, the black ink and inks of three colors land at exactly the same position on the slope 52 of the guide member 51. The landing position of each color ink, however, may be slightly above the landing position of the black ink. According to this configuration, when the black ink has solidified on the slope 52 of the guide member 81, since each color ink can land on the upper edge of the solidified black ink, the solidified black ink can be dissolved in each color ink easily. In this case, a position including both of the landing position of each color ink and the landing position of the black ink corresponds to the second landing position of the present teaching.

In the flushing performed when no printing is being performed according to this embodiment, inks of three colors land on the guide member 51 after landing of the black ink. The black ink, however, may land on the guide member 51 after landings of inks of three colors.

Figure 8A:
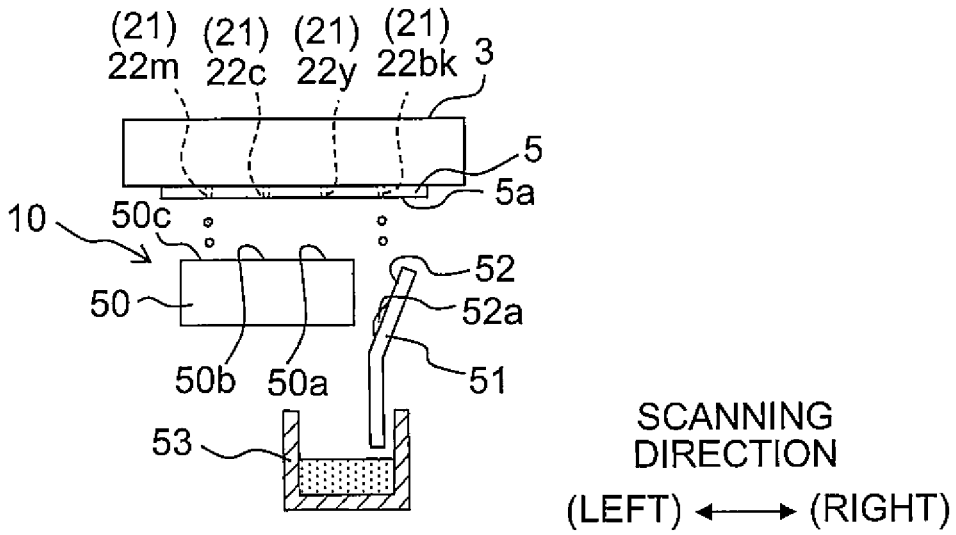
FIGS. 8A and 8B are illustrative views each illustrating flushing performed when no printing is being performed, in accordance with a modified embodiment.
Figure 8B:
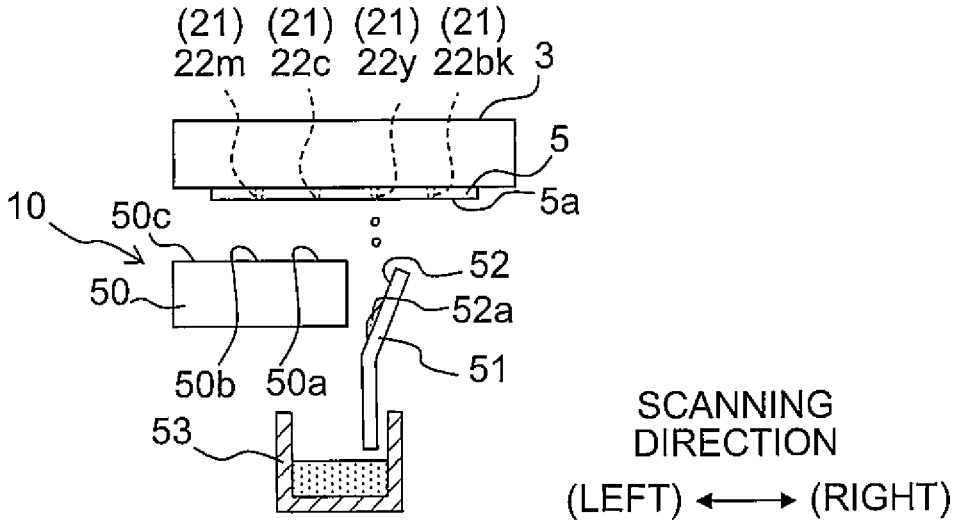

In the flushing performed when no printing is being performed according to this embodiment, inks of all three colors land on the guide member 51. However, as depicted in FIGS. 8A and 8B, any one or two of inks of three colors may land on the guide member 51 and other ink(s) may land on the ink absorbing member 50. The yellow and cyan inks are less likely to solidify than the magenta ink, and thus it is preferred that at least one of the yellow and cyan inks land on the guide member 51. In this modified embodiment, any two of inks of three colors may be jetted so that the time during which one of the two inks is jetted from its nozzle row overlaps at least partially with the time during which the other of the two inks is jetted from its nozzle row. Thus, the time required for the flushing can be shortened.

The flushing performed when no printing is being performed may be performed at any timing in addition to those in the above embodiment. For example, when a predetermined condition is satisfied (e.g., when the number of sheets printed during a single printing process has reached a predetermined number of sheets), the flushing may be performed immediately after the ink-jet head 5 completes the printing.

It has been described in the above embodiment that the flushing performed immediately after power is applied to the printer 1 is not always performed every time power is applied to the printer 1. This flushing, however, may be performed every time power is applied to the printer 1. Further, it has been described in the above embodiment that the suction purge immediately after power is applied to the printer 1 is not always performed every time power is applied to the printer 1. This suction purge, however, may be performed every time power is applied to the printer 1.

In the above embodiment, all of the four inks land on the guide member 51 in all of the flushings performed when no printing is being performed. The present teaching, however, is not limited to this. That is, provided that all of the four inks land on the guide member 51 in some flushings of the flushings performed when no printing is being performed, inks of three colors may land on the ink absorbing member 50 instead of landing on the guide member 51 in any other flushings than the above some flushings, in a similar manner to the flushing performed when the printing is being performed.

As an example of this modified embodiment, it is allowable to adopt the following configuration. That is, all of the four inks land on the guide member 51 at least during the flushing after the purge, of the flushings performed when no printing is being performed; and inks of three colors land on the ink absorbing member 50 and the black ink lands on the guide member 51 during any other flushings than the flushing after the purge. Since the amounts of inks jetted during the flushing after the purge are especially larger than those jetted during any other flushings, the black ink adhering to the guide member 51 can be dissolved in the color inks more reliably.

Alternatively, the following configuration is also allowable. That is, all of the four inks land on the guide member 51 only during the flushing performed after the first purge after power is applied to the printer 1, of the flushings after the purge; and inks of three colors land on the ink absorbing member 50 and the black ink lands on the guide member 51 during any other flushings after the purge than the flushing after the first purge. According to this configuration, during a flushing after a purge based on a purge command by a user, the black ink is jetted to land on the guide member 51 and inks of three colors are jetted to land on the ink absorbing member 50 so that the time during which the black ink is jetted from its nozzle row overlaps at least partially with each of the times during which each of the inks of three colors is jetted from one of nozzle rows. This reduces the time required for the flushing and the user waiting time.

As still another modified embodiment, the following configuration is also allowable. That is, all of the four inks land on the guide member 51 at least during a regular flushing, of the flushings performed when no printing is being performed; and inks of three colors land on the ink absorbing member 50 and the black ink lands on the guide member 51 during any other flushings than the regular flushing. The regular flushing is irrelevant to the user's command, and is performed automatically and regularly. Thus, any problem such as a long user waiting time will not occur, even when the flushing takes a long time.

In the above embodiment, inks of three colors land on the ink absorbing member 50 and the black ink lands on the guide member 51 during all of the flushings performed when the printing is being performed. The present teaching, however, is not limited to this. That is, provided that the black ink lands on the guide member 51 and inks of three colors land on the ink absorbing member 50 in some flushings of the flushings performed when the printing is being performed, all of the four inks may land on the ink guide member 51 in any other flushings than the some flushings, in a similar manner as the flushing performed when no printing is being performed.

As an example of this modified embodiment, it is allowable to adopt the following configuration. That is, the black ink lands on the guide member 51 and inks of three colors land on the ink absorbing member 50 only during the flushing in which the time elapsed after the last printing before a printing command is less than a predetermined time, of the flushings performed after a printing command is inputted before the ink-jet head 5 starts printing; and all of the four inks may land on the guide member 51 during a flushing in which the time elapsed after the last printing before a printing command exceeds the predetermined time. When the time elapsed after the last printing is long, the time elapsed after the last flushing may be also long. Thus, it is highly possible that the black ink is adhering to the guide member 51. The configuration in accordance with modified embodiment can efficiently prevent accumulation of black ink on the guide member 51 without taking an unnecessarily long time for printing.

As yet another modified embodiment, the following configuration is also allowable. That is, the black ink lands on the guide member 51 and inks of three colors land on the ink absorbing member 50 only during the flushing performed when the number of sheets printed in the last printing is less than a predetermined number of sheets, of the flushings performed after a printing command is inputted before the ink-jet head 5 starts printing; and all of the four inks land on the guide member 51 during a flushing performed when the number of sheets printed in the last printing exceeds the predetermined number of sheets. When the last printing was performed for many sheets, it is assumed that the flushing was performed also many times when the printing was being performed. This leads to a large amount of black ink adhering to the guide member 51. The configuration in accordance with modified embodiment, however, can efficiently prevent accumulation of the black ink on the guide member 51 without taking an unnecessarily long time for printing.

Further, the following configuration is also allowable. That is, the black ink lands on the guide member 51 and inks of three colors land on the ink absorbing member 50 during a flushing which has a big influence on printing time, of the flushings performed when the printing is being performed; and all of the four inks land on the guide member 51 during a flushing which has a small influence on printing time. Specifically, for example, since a flushing performed between passes has a big influence on printing time, it is preferred that the black ink lands on the guide member 51 and inks of three colors land on the ink absorbing member 50. However, when the conveyance operation of the recording sheet P and the printing by the ink-jet head 5 are temporarily stopped between passes, for example, in order to dry the ink which landed on the recording sheet P, all of the four inks may land on the guide member 51. Further, for example, when printing is performed for recording sheets P during a single printing process, all of the four inks may land on the guide member 51. This is because, a flushing performed before printing is performed for the n-th recording sheet P (n is a predetermined numeral determined in the printer 1) has a small influence on printing time.

In the flushing performed when the printing is being performed according to the above embodiment, the time during which the black ink is jetted from the nozzle row 22*bk* overlaps at least partially with each of the times during which each of the inks of three colors is jetted from one of three nozzle rows 22*y*, 22*c*, and 22*m*. However, the time during which the black ink is jetted from the nozzle row 22*bk* may overlap at least partially with the time during which at least one of the inks of three colors is jetted from each of three nozzle rows 22*y*, 22*c*, and 22*m*.

In the flushing performed when the printing is being performed, the time during which the black ink is jetted from the nozzle row 22*bk* may not overlap with each of the times during which each of the inks of three colors is jetted from one of three nozzle rows 22*y*, 22*c*, and 22*m*. Instead of the above, the inks are jetted from four nozzle rows with the ink-jet head 5 stopped at a predetermined position. In this configuration, the ink-jet head 5 is not required to move while the four inks are jetted from four ink nozzle rows respectively. This can reduce the time required for the flushing.

In the above embodiment, the ink absorbing member 50 includes the first landing position of the present teaching, and the slope 52 of the guide member 51 includes the second landing position of the present teaching. However, the members having the first and second landing positions of the present teaching are not limited to those. For example, a member made of an ink absorbing material may include both of the first and second landing positions. However, it is preferred that a member including the second landing position be the guide member 51, this is because the black ink adhering to the second landing position can be dissolved in color inks so as to slide down the slope 52 of the guide member 51.

In the above embodiment, the ink in the ink-jet head 5 is discharged through the suction purge in which the ink is sucked from the nozzles 21. The ink in the ink-jet head 5, however, may be discharged through the push purge in which pressure is applied to the ink in the ink-jet head 5 by means of a pressurized pump provided on the upstream side of the ink-jet head 5. In this case, the pressurized pump corresponds to a purge mechanism of the present teaching.

In the above embodiment, the recording sheet P (the medium of the present teaching) is conveyed by means of the feed roller 7 and the discharge roller 8. The conveyance mechanism for conveying the recording sheet P, however, may have any other structure than the above.

In the embodiment and the modified embodiments explained above, the present teaching is applied to the ink-jet printer which jets the ink to the recording sheet to print an image and the like. However, the present teaching is also applicable to a liquid jetting apparatus used in various applications other than the printing of an image and the like. For example, the present teaching is applicable also to a liquid jetting apparatus which jets a conductive liquid to a substrate to form a conductive pattern on the surface of the substrate.

What is claimed is:

1. A liquid jetting apparatus configured to jet first liquid and second liquid on a medium, comprising:

a liquid jetting head including a first nozzle from which the first liquid is jetted and a second nozzle which is aligned with the first nozzle in a first direction and from which the second liquid is jetted, the second liquid being more likely to solidify than the first liquid;

a head driving unit configured to move the liquid jetting head in the first direction;

a flushing receiving part including a first landing position and a second landing position aligned in the first direction; and a controller configured to:

control the liquid jetting head and the head driving unit to perform a liquid-jetting process in which the first and second liquids are respectively jetted from the first and second nozzles toward the medium;

control the liquid jetting head and the head driving unit to perform a flushing process in which the first and second liquids are respectively jetted from the first and second nozzles toward the flushing receiving part;

control the liquid jetting head and the head driving unit to jet the first and second liquids from the first and second nozzles respectively such that the first and second liquids land on the first and second landing positions respectively during jetting periods of the first and second liquids at least a part of which overlap with each other, in a case that the flushing process is performed in a state that the liquid-jetting process is performed; and control the liquid jetting head to move during a period between jetting of the first liquid from the first nozzles and jetting of the second liquid from the second nozzles such that the first and second liquids land on the second landing position, in the case that the flushing process is performed in a state that the liquid-jetting process is not performed.

2. The liquid jetting apparatus according to claim 1, further comprising:

a purge mechanism configured to discharge the first and second liquids from the first and second nozzles of the liquid jetting head, respectively;

wherein the controller is configured to:

control the purge mechanism to perform a purging process in which the first and second liquids are discharged from the first and second nozzles respectively, in the state that the liquid-jetting process is not performed; and control the liquid jetting head to jet the first liquid such that the first liquid lands on the second landing position in the flushing process performed after the purging process.

3. The liquid jetting apparatus according to claim 2;

wherein the controller is configured to:

determine whether the liquid jetting process is being performed under a condition that an instruction for performing the flushing process is received; and control the liquid jetting head and the head driving unit to perform the flushing process such that the first and second liquids land on the second landing position, under a condition that the controller determines:

that the liquid jetting process is being performed; and that the instruction for performing the flushing process has been received immediately after the purging process, or immediately after the liquid jetting apparatus was turned on, or immediately after the liquid jetting apparatus was recovered from a sleep state, or immediately after a predetermined time elapsed since last time the purging process had been performed.

4. The liquid jetting apparatus according to claim 2;

wherein the controller is configured to:

determine whether the liquid jetting process is being performed under a condition that an instruction for performing the flushing process is received;

control the liquid jetting head and the head driving unit to perform the flushing process such that the first and second liquids land on the second landing position, under a condition that the controller determines:

that the liquid jetting process is being performed; and that the instruction for performing the flushing process has been received immediately after the purging process which is a first purging process since the liquid jetting apparatus was turned on; and control the liquid jetting head and the head driving unit to perform the flushing process such that the first and second liquids land on the first and second landing positions respectively, under a condition that the controller determines:

that the liquid jetting process is being performed; and that the instruction for performing the flushing process has been received immediately after the purging process which is a second purging process or later since the liquid jetting apparatus was turned on.

5. The liquid jetting apparatus according to claim 1;

wherein the controller is configured to:

control the head to perform the flushing process regularly, at a predetermined time interval, in the state that the liquid-jetting process is not performed; and control the liquid jetting head to jet the first liquid such that the first liquid lands on the second landing position in the flushing process performed regularly.

6. The liquid jetting apparatus according to claim 1;

wherein the controller is configured to control the liquid jetting head to jet the second liquid such that the second liquid lands on the second landing position before the controller is configured to control the liquid jetting head to jet the first liquid such that the first liquid lands on the second landing position, in the case that the flushing process is performed in the state that the liquid-jetting process is not performed.

7. The liquid jetting apparatus according to claim 1;

wherein the first liquid is a dye ink and the second liquid is a pigment ink.

8. The liquid jetting apparatus according to claim 7;

wherein the first liquid is a color dye ink and the second ink is a black pigment ink.

9. The liquid jetting apparatus according to claim 1;

wherein an amount of the first liquid, which is jetted from the first nozzles during the flushing process performed in the state that the jetting process for the medium is not performed, is larger than an amount of the first liquid, which is jetted from the first nozzles during the flushing process performed in the state that the liquid-jetting process is performed.

10. The liquid jetting apparatus according to claim 1; wherein the flushing receiving part includes a liquid absorbing member and a guide member, the liquid absorbing member having the first landing position and being made of a liquid absorbing material, the guide member including a slope which has the second landing position and on which the first and second liquids land so as to slide down.

11. The liquid jetting apparatus according to claim 1; wherein the controller is configured to:

determine whether the liquid jetting process is being performed under a condition that an instruction for performing the flushing process is received;

control the liquid jetting head and the head driving unit to perform the flushing process such that the first and second liquids land on the first and second landing positions respectively, under a condition that the controller determines the liquid jetting process is being performed; and control the liquid jetting head and the head driving unit to perform the flushing process such that the first and second liquids land on the second landing position, under a condition that the controller determines the liquid jetting process is not being performed.

12. The liquid jetting apparatus according to claim 1; wherein the controller is configured to:

determine whether the liquid jetting process is being performed under a condition that an instruction for performing the flushing process is received;

control the liquid jetting head and the head driving unit to perform the flushing process such that the first and second liquids land on the first and second landing positions respectively, under a condition that the controller determines:

that the instruction for performing the flushing process has been received before the liquid jetting process is performed; and that a predetermined time has not been elapsed since last time the liquid jetting process had been performed; and control the liquid jetting head and the head driving unit to perform the flushing process such that the first and second liquids land on the second landing position, under a condition that the controller determines:

that the instruction for performing the flushing process has been received before the liquid jetting process is performed; and that a predetermined time has been elapsed since last time the liquid jetting process had been performed.

13. The liquid jetting apparatus according to claim 1; wherein the controller is configured to:

determine whether the liquid jetting process is being performed under a condition that an instruction for performing the flushing process is received;

control the liquid jetting head and the head driving unit to perform the flushing process such that the first and second liquids land on the first and second landing positions respectively, under a condition that the controller determines:

that the instruction for performing the flushing process has been received before the liquid jetting process is performed; and that a number of the media on which the first and second liquids are jetted until last time the liquid jetting process had been performed is not larger than a predetermined number; and control the liquid jetting head and the head driving unit to perform the flushing process such that the first and second liquids land on the second landing position, under a condition that the controller determines:

that the instruction for performing the flushing process has been received before the liquid jetting process is performed; and that a number of the media on which the first and second liquids are jetted until last time the liquid jetting process had been performed is larger than the predetermined number.

14. The liquid jetting apparatus according to claim 1; wherein the controller is configured to:

determine whether the liquid jetting process is being performed under a condition that an instruction for performing the flushing process is received;

determine whether the flushing process is to be performed between two successive movements of the liquid jetting head in the first direction, or is to be performed before a liquid jetting process in which the first and second liquids are respectively jetted from the first and second nozzles toward a medium of a predetermined order;

control the liquid jetting head and the head driving unit to perform the flushing process such that the first and second liquids land on the first and second landing positions respectively, under a condition that the controller determines:

that the liquid jetting process is being performed; and that the flushing process is to be performed between the two successive movements of the liquid jetting head in the first direction; and control the liquid jetting head and the head driving unit to perform the flushing process such that the first and second liquids land on the second landing position, under a condition that the controller determines:

that the liquid jetting process is being performed; and that the flushing process is to be performed before the liquid jetting process in which the first and second liquids are respectively jetted from the first and second nozzles toward the medium of the predetermined order.

15. A liquid jetting apparatus configured to jet a first liquid and a second liquid on a medium, comprising:

a liquid jetting head including a first nozzle from which the first liquid is jetted and a second nozzle which is aligned with the first nozzle in a first direction and from which the second liquid is jetted, the second liquid being more likely to solidify than the first liquid;

a head driving unit configured to move the liquid jetting head in the first direction;

a flushing receiving part including a first landing position and a second landing position aligned in the first direction; and a controller configured to:

control the liquid jetting head and the head driving unit to perform a liquid-jetting process in which the first and second liquids are respectively jetted from the first and second nozzles toward the medium;

control the liquid jetting head and the head driving unit to perform a flushing process in which the first and second liquids are jetted from the first and second nozzles toward the flushing receiving part;

control the liquid jetting head and the head driving unit to jet the first and second liquids from the first and second nozzles respectively such that the first and second liquids land on the first and second landing positions respectively, with the liquid jetting head stopped at a predetermined jetting position, in a case that the flushing process is performed in a state that the liquid-jetting process is performed; and control the liquid jetting head to move during a period between jetting of the first liquid from the first nozzles and jetting of the second liquid from the second nozzles such that the first and second liquids land on the second landing position, in the case that the flushing process is performed in a state that the liquid-jetting process is not performed.

16. The liquid jetting apparatus according to claim 15, further comprising a purge mechanism configured to discharge the first and second liquids from the first and second nozzles of the liquid jetting head;

wherein the controller is configured to:

control the purge mechanism to perform a purging process in which the first and second liquids are discharged from the first and second nozzles respectively, in the state that the liquid-jetting process is not performed; and control the liquid jetting head to jet the first liquid such that the first liquid lands on the second landing position in the flushing process performed after the purging process.

17. The liquid jetting apparatus according to claim 16; wherein the controller is configured to:

determine whether the liquid jetting process is being performed under a condition that an instruction for performing the flushing process is received; and control the liquid jetting head and the head driving unit to perform the flushing process such that the first and second liquids land on the second landing position, under a condition that the controller determines:

that the liquid jetting process is being performed; and that the instruction for performing the flushing process has been received immediately after the purging process, or immediately after the liquid jetting apparatus was turned on, or immediately after the liquid jetting apparatus was recovered from a sleep state, or immediately after a predetermined time elapsed since last time the purging process had been performed.

18. The liquid jetting apparatus according to claim 16; wherein the controller is configured to:

determine whether the liquid jetting process is being performed under a condition that an instruction for performing the flushing process is received;

control the liquid jetting head and the head driving unit to perform the flushing process such that the first and second liquids land on the second landing position, under a condition that the controller determines:

that the liquid jetting process is being performed; and that the instruction for performing the flushing process has been received immediately after the purging process which is a first purging process since the liquid jetting apparatus was turned on; and control the liquid jetting head and the head driving unit to perform the flushing process such that the first and second liquids land on the first and second landing positions respectively, under a condition that the controller determines:

that the liquid jetting process is being performed; and that the instruction for performing the flushing process has been received immediately after the purging process which is a second purging process or later since the liquid jetting apparatus was turned on.

19. The liquid jetting apparatus according to claim 15; wherein the controller is configured to:

control the liquid jetting head to perform the flushing process regularly, at a predetermined time interval, in the state that the liquid-jetting process is not performed; and control the liquid jetting head to jet the first liquid such that the first liquid lands on the second landing position in the flushing process performed regularly.

20. The liquid jetting apparatus according to claim 15; wherein the controller is configured to control the liquid jetting head to jet the second liquid such that the second liquid lands on the second landing position before the controller is configured to control the liquid jetting head to jet the first liquid to such that the first liquid lands on the second landing position, in the case that the flushing process is performed in the state that the liquid-jetting process is not performed.

21. The liquid jetting apparatus according to claim 15; wherein the first liquid is a dye ink and the second liquid is a pigment ink.

22. The liquid jetting apparatus according to claim 21; wherein the first liquid is a color dye ink and the second ink is a black pigment ink.

23. The liquid jetting apparatus according to claim 15; wherein an amount of the first liquid, which is jetted from the first nozzles during the flushing process performed in the state that the liquid-jetting process is not performed, is larger than an amount of the first liquid, which is jetted from the first nozzles during the flushing process performed in the state that the liquid-jetting process is performed.

24. The liquid jetting apparatus according to claim 15; wherein the flushing receiving part includes a liquid absorbing member and a guide member, the liquid absorbing member having the first landing position and being made of a liquid absorbing material, the guide member including a slope which has the second landing position and on which the first and second liquids land so as to slide down.

25. The liquid jetting apparatus according to claim 15; wherein the controller is configured to:

determine whether the liquid jetting process is being performed under a condition that an instruction for performing the flushing process is received;

control the liquid jetting head and the head driving unit to perform the flushing process such that the first and second liquids land on the first and second landing positions respectively, under a condition that the controller determines the liquid jetting process is being performed; and control the liquid jetting head and the head driving unit to perform the flushing process such that the first and second liquids land on the second landing position, under a condition that the controller determines the liquid jetting process is not being performed.

26. The liquid jetting apparatus according to claim 15; wherein the controller is configured to:

determine whether the liquid jetting process is being performed under a condition that an instruction for performing the flushing process is received;

control the liquid jetting head and the head driving unit to perform the flushing process such that the first and second liquids land on the first and second landing positions respectively, under a condition that the controller determines:

that the instruction for performing the flushing process has been received before the liquid jetting process is performed; and that a predetermined time has not been elapsed since last time the liquid jetting process had been performed; and control the liquid jetting head and the head driving unit to perform the flushing process such that the first and second liquids land on the second landing position, under a condition that the controller determines:

that the instruction for performing the flushing process has been received before the liquid jetting process is performed; and that a predetermined time has been elapsed since last time the liquid jetting process had been performed.

27. The liquid jetting apparatus according to claim 15; wherein the controller is configured to:

determine whether the liquid jetting process is being performed under a condition that an instruction for performing the flushing process is received;

control the liquid jetting head and the head driving unit to perform the flushing process such that the first and second liquids land on the first and second landing positions respectively, under a condition that the controller determines:

that the instruction for performing the flushing process has been received before the liquid jetting process is performed; and that a number of the media on which the first and second liquids are jetted until last time the liquid jetting process had been performed is not larger than a predetermined number; and control the liquid jetting head and the head driving unit to perform the flushing process such that the first and second liquids land on the second landing position, under a condition that the controller determines:

that the instruction for performing the flushing process has been received before the liquid jetting process is performed; and that a number of the media on which the first and second liquids are jetted until last time the liquid jetting process had been performed is larger than the predetermined number.

28. The liquid jetting apparatus according to claim 15; wherein the controller is configured to:

determine whether the liquid jetting process is being performed under a condition that an instruction for performing the flushing process is received;

determine whether the flushing process is to be performed between two successive movements of the liquid jetting head in the first direction, or is to be performed before a liquid jetting process in which the first and second liquids are respectively jetted from the first and second nozzles toward a medium of a predetermined order;

control the liquid jetting head and the head driving unit to perform the flushing process such that the first and second liquids land on the first and second landing positions respectively, under a condition that the controller determines:

that the liquid jetting process is being performed; and that the flushing process is to be performed between the two successive movements of the liquid jetting head in the first direction; and control the liquid jetting head and the head driving unit to perform the flushing process such that the first and second liquids land on the second landing position, under a condition that the controller determines:

that the liquid jetting process is being performed; and that the flushing process is to be performed before the liquid jetting process in which the first and second liquids are respectively jetted from the first and second nozzles toward the medium of the predetermined order.

* * * * *